US007099811B2

(12) United States Patent
Ding et al.

(10) Patent No.: US 7,099,811 B2
(45) Date of Patent: Aug. 29, 2006

(54) METHOD OF DETERMINING BY NUMERICAL SIMULATION THE RESTORATION CONDITIONS, BY THE FLUIDS OF A RESERVOIR, OF A COMPLEX WELL DAMAGED BY DRILLING OPERATIONS

(75) Inventors: Yu Didier Ding, Chatou (FR); Daniel Longeron, Sartrouville (FR); Gérard Renard, Rueil Malmaison (FR); Annie Audibert Hayet, Croissy sur Seine (FR)

(73) Assignee: Institut Francais Du Petrole, Rueil Malmaison Cedex (FR)

( * ) Notice: Subject to any disclaimer, the term of this patent is extended or adjusted under 35 U.S.C. 154(b) by 870 days.

(21) Appl. No.: 10/139,242

(22) Filed: May 7, 2002

(65) Prior Publication Data

US 2002/0188431 A1 Dec. 12, 2002

(30) Foreign Application Priority Data

May 9, 2001 (FR) ..... 01 06216
Jun. 12, 2001 (FR) ..... 01 07764

(51) Int. Cl.
*G06G 7/48* (2006.01)

(52) U.S. Cl. ..... 703/10

(58) Field of Classification Search ..... 703/10; 507/201; 702/6–13; 166/278
See application file for complete search history.

(56) References Cited

OTHER PUBLICATIONS

Beall et al., Evaluation of a New Technique For Removing Horizontal Wellbore Damage Attributable to Drill-In Filter Cake, SPE 36429, Oct. 96, pp. 133-145.*

Pedrosa and Aziz, Use of Hybrid Grid in Reservoir Simulation, SPE 13507, Nov. 1986, pp. 611-621.*

Pierre Cerasi, Physical Modelling Of Drilling Fluid Filter Cake Failure Phenomena, Energy "Marie Curie" Research Training Fellowships Conference, Clamart, France, May 15-17, 2000, pp. 1-10.*

Y. Ding, et al., "Modelling of Near-Wellbore Damage Removal by Natural Cleanup in Horizontal Open Hole Completed Wells", XP0-002187166, Paper SPE-68951, SPE European Formation Damage Conference, May 21, 2001, pp. 1-14.

French Search Report w/English language translation.

Longeron, D., et al, "An Integrated Experimental Approach for Evaluating Formation Damage due to Drilling and Completion Fluids", 1995, SPE 30089, pp. 117-131.

(Continued)

*Primary Examiner*—Paul L. Rodriguez
*Assistant Examiner*—Juan Carlos Ochoa
(74) *Attorney, Agent, or Firm*—Antonelli, Terry, Stout & Kraus, LLP.

(57) ABSTRACT

The method essentially comprises acquiring initial data obtained by laboratory measurements of the values, according to the initial permeability of the formations surrounding the well, of the thickness of the cakes and of the damaged permeability and restored permeability values of this zone, as a function of the distance to the wall of the well. Then the damaged zone is discretized by a 3D cylindrical grid pattern forming blocks of small radial thickness in relation to the diameter of the well, and the diffusivity equation, modelling the flow of the fluids through the cakes, is solved in this grid pattern by taking account of the measured initial data. Finally, the evolution of the permeability is modelled as a function of the flow rates of fluids flowing through the cakes, so as to deduce therefrom the optimum conditions to be applied for producing the well.

2 Claims, 9 Drawing Sheets

OTHER PUBLICATIONS

Alfenor, J., et al, "What really Matters in our Quest of minimizing Formation Damager in Open Hole Horizontal Wells", 1999, SPE 54731, pp. 1-14.

Longeron, D., et al, "Experimental Approach to Characterize Drilling Mud Invasion, Formation Damage and Cleanup Efficiency In Horizontal Wells with Openhole Completions", 2000, SPE 58737, pp. 1-13.

* cited by examiner

| **r** (m)<br>**NR = 16** | θ<br>**Nθ = 1** | **x** (m)<br>**NX = 80** |
|---|---|---|
| 0.00625 0.00625 0.0125 0.025 0.05 0.1 0.2 0.4 0.8 1.6 3.2 6.4 12.8 25. 50. 50. 100. 200. 300. 400. 600. | 2π | 80x0.25 |

Fig. 17

| Cas 2 | |
|---|---|
| p (bar) | t (jour) |
| 319.5 | 0.0 - 0.1 |
| 319.4 | 0.1 - 0.2 |
| 319.3 | 0.2 - 0.3 |
| 319.2 | 0.3 - 0.4 |
| 319.1 | 0.4 - 0.5 |
| 319.0 | 0.5 - 0.6 |
| 318.9 | 0.6 - 0.7 |
| 318.8 | 0.7 - 0.8 |
| 318.7 | 0.8 - 0.9 |
| 318.6 | 0.9 - 1.0 |
| 318.5 | 1.0 - 1.1 |
| 318.4 | 1.1 - 1.2 |
| 318.3 | 1.2 - 1.3 |
| 318.2 | 1.3 – 5.0 |

Fig. 18

METHOD OF DETERMINING BY NUMERICAL SIMULATION THE RESTORATION CONDITIONS, BY THE FLUIDS OF A RESERVOIR, OF A COMPLEX WELL DAMAGED BY DRILLING OPERATIONS

BACKGROUND OF THE INVENTION

1. Field of the Invention

The present invention relates to a method of determining by numerical simulation the optimum conditions to be applied in a horizontal (or complex) well drilled through an underground reservoir, so as to progressively eliminate (restore), by flushing by means of the production fluids from the reservoir, deposits or cakes formed in at least a peripheral zone of the well, as a result of drilling and completion operations.

It is well-known to the man skilled in the art to distinguish between the cakes referred to as internal cakes, formed by mud invasion of the rock pores, and the cakes referred to as external cakes, consisting of a mud coat on the external wall of the well.

2. Description of the Prior Art

It is well-known in the art to distinguish between the cakes referred to as internal cakes, formed by mud invasion of the rock pores, and the cakes referred to as external cakes, consisting of a mud coat on the external wall of the well.

The damage caused to the formations surrounding horizontal (or complex) wells, often open holes equipped for production and constitutes a critical point for deep offshore oil fields where only a limited number of very productive wells are produced so as to obtain acceptable development costs.

The tests that can be carried out to characterize formation damage in the vicinity of a well are of early stage importance. They allow selection of the most suitable drilling fluid to minimize or reduce permeability deterioration in the vicinity of the wells and to optimize well cleaning techniques.

During the past five years, the assignee has developed a specific laboratory test equipment and procedures intended to characterize formation damage due to drilling during operations under overpressure conditions and to quantify the performances of the various cleaning techniques used in the industry, as shown in the following publications:

Alfenore, J. et al., "What Really Matters in our Quest of Minimizing Formation Damage in Open Hole Horizontal Wells", 1999, SPE 54731, Longeron, D. et al., "Experimental Approach to Characterize Drilling Mud Invasion, Formation Damage and Cleanup Efficiency in Horizontal Wells with Openhole Completions", 2000, SPE 58737, or Longeron, D. et al., "An Integrated Experimental Approach for Evaluating Formation Damage due to Drilling and Completion Fluids", 1995, SPE 30089.

However, the surveys carried out in the laboratory are often insufficient by themselves to realistically model the production conditions to be applied in wells so as to best restore the permeability of the surrounding formations without causing sand encroachment. Modelling the procedures for restoring formations surrounding a well is of great economic interest for the production of oil fields.

SUMMARY OF THE INVENTION

The method according to the invention allows to best simulate the optimum conditions to be applied in a well drilled through an underground reservoir with any trajectory, so as to progressively eliminate, by means of the reservoir fluids, deposits or cakes formed in at least a peripheral zone of the well as a result of drilling operations.

It comprises acquiring initial data obtained by laboratory measurements of the initial permeability values (ki) of the formations surrounding the well, the thickness of the cakes and the damaged permeability (kd) and restored permeability (kf) values of this zone, as a function of the distance (r) to the wall of the well, discretizing the damaged zone by means of a 3D cylindrical grid pattern forming blocks of small radial thickness in relation to the diameter of the well, and solving in this grid pattern diffusivity equations modelling the flow of the fluids through the cakes by taking accounting for the measured initial data and by modelling the evolution of the permeability as a function of the flow rates (Q) of fluids flowing through the cakes, so as to deduce therefrom the optimum conditions to be applied for producing the well.

Permeability restoration is modelled at any point at a distance (r) from the wall by considering for example that the permeability varies proportionally to the difference between the damaged permeability (kd) and the restored permeability (kf), the proportionality coefficient depending on an empirical law of permeability variation as a function of the quantity of fluids through the cakes.

The simulation performed according to the method allows reservoir engineers to better predict the best development scheme for the reservoir while avoiding drawbacks such as sand encroachment. It also allows drillers to select fluids more particularly suited for well drilling and equipment setting, considering the known or estimated permeability data.

BRIEF DESCRIPTION OF THE DRAWINGS

Other features and advantages of the method and of the device according to the invention will be clear from reading the description hereafter of a non limitative example, with reference to the accompanying drawings wherein:

FIG. 17 is a chart showing an example of gridding with NX grid cells distributed along the well, progressively thicker as they are radially further from the wall of the well (direction r(m)); and FIG. 18 is a chart showing the application time t(d), expressed in days, of an imposed bottomhole pressure P(bar).

DETAILED DESCRIPTION OF THE INVENTION

I—Laboratory Data Acquisition

Figure 1:
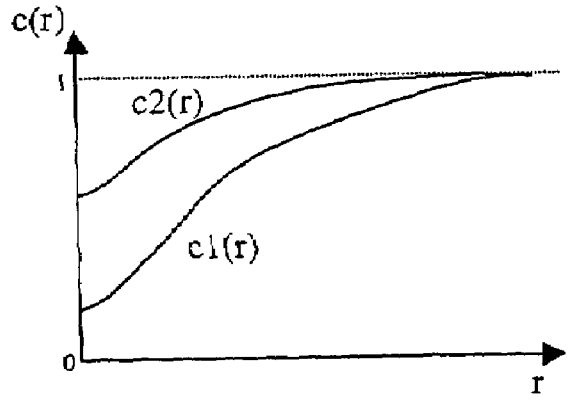
FIG. 1 shows the curves of variation, as a function of the distance r to the wall of the damaged well, of a first multiplying coefficient $c_1(r)$ of the damaged permeability and of a second multiplying coefficient $c_2(r)$ of the restored permeability.

Formation damage tests are of early stage importance for minimizing or reducing the permeability deterioration in the vicinity of wells by selecting the most suitable drilling fluid and by optimizing the well cleaning techniques. During the past five years, the assignee has developed a specific laboratory test equipment and procedures intended to characterize the formation damage due to drilling during operations under overpressure conditions and to quantify the performances of the various cleaning techniques used in the industry, as shown in the following publications:

Alfenore, J. et al., "What Really Matters in our Quest of Minimizing Formation Damage in Open Hole Horizontal Wells", 1999, SPE 54731, Longeron, D. et al., "Experimental Approach to Characterize Drilling Mud Invasion, Formation Damage and Cleanup Efficiency in Horizontal Wells with Openhole Completions", 2000, SPE 58737, or Longeron, D. et al., "An Integrated Experimental Approach for Evaluating Formation Damage due to Drilling and Completion Fluids", 1995, SPE 30089.

The leak-off pressure tests are carried out with a dynamic filtration cell which can receive 5-cm diameter cores whose length can reach 40 cm. The cell is for example equipped with five pressure taps arranged 5, 10, 15, 20 and 25 cm away from the inlet face of the core. The pressure taps allow monitoring of the pressure drops through six sections of the core while mud is circulated and oil is circulated back in order to simulate production. In order to reproduce the dynamic process of mud and mud filtrate invasion, the laboratory tests are carried out under representative well conditions (temperature, overpressure and shear rate applied to the mud, cores saturated with oil and connate water, etc.). Oil is then injected in the opposite direction (backflow) at constant flow rate so as to simulate well production. The evolution of the restored permeabilities is calculated, for each section, as a function of the cumulative volume of oil injected. The final stabilized value of the restored permeability is then compared with the initial non deteriorated permeability in order to evaluate the residual deterioration as a function of the distance to the inlet face of the core. It has generally been observed that a total amount of 10 to 20 PV (a hundred PV at most) of injected oil was enough to obtain a stabilized value for the restored permeability after damage with an oil-base mud.

II—Simplified Numerical Model for Suppressing the Damage in the Vicinity of the Well Considering a well drilled in the oil zone with an oil-base mud, the properties of the oil in the reservoir are assumed to be identical to those observed in the filtrate. The equation of flow (diffusivity equation) in the vicinity of the well is thus governed by a single-phase equation expressed as follows:

$$-div\left(\frac{k}{\mu}\nabla p\right) = c\phi\frac{\partial p}{\partial t} \tag{1}$$

where p is the pressure, k the absolute permeability, μ the viscosity, c the compres-sibility and ϕ the porosity. The viscosity μ and the compressibility c in the filtrate are considered to be similar to those observed in the oil that saturates the reservoir. The initial pressure in the reservoir is considered to be hydrostatic at production start.

II-1 Modelling the Internal Filter Cake

The internal filter cake reduces the permeability of the reservoir in the vicinity of the well. As mentioned above, the permeability reductions after the drilling period and at the end of a complete cleaning operation can be obtained from laboratory measurements. For modelling, the permeability reduction factor is used in dimensionless form to represent the permeability variation. Using the dimensionless forms affords the advantage of allowing the data to be grouped together by geologic zones.

Let $k_i$ be the initial permeability, $k_d$ the damage permeability and $k_f$ the final restored permeability; the damage permeability and the final restored permeability generally depend on r the distance to the well.

Then $$c_1(r) = \frac{k_d(r)}{k_i} \text{ and } c_2(r) = \frac{k_f(r)}{k_i}$$

are the curves of the permeability reduction factor as a function of r before cleaning and after the fluid backflow respectively (FIG. 1), the permeability variation in the vicinity of the well is generally limited by these two curves during the fluid backflow period. $c_1(r)$ corresponds to the damage permeability curve and $c_2(r)$ to the stabilized restored permeability curve.

Figure 2:
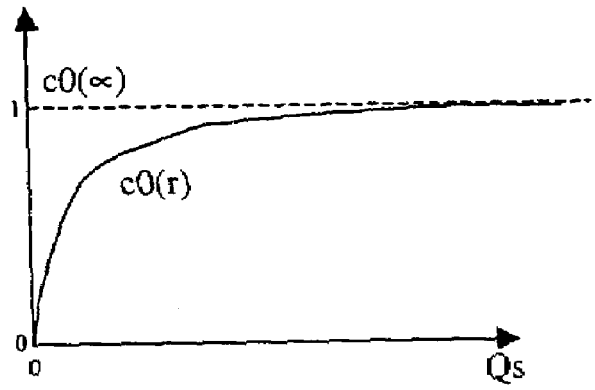
FIG. 2 shows an empirical law of variation of a variation coefficient of the permeability at a distance r from the wall of the damaged well, as a function of the fluid flow rate $Q_s$ through the cakes.

As mentioned above, the permeability variation in the zone occupied by the internal filter cake during the fluid backflow period depends on the amount of oil produced flowing towards the well. The dimensionless form is used as follows to describe this variation (FIG. 2):

$$c_0(Q) = \frac{k(Q) - k_d}{k_f - k_d} \tag{2}$$

where Q is the total rate of flow through the porous medium in the direction of the flow divided by the porous surface (pore surface available for the flow). This curve represents the permeability variation in relation to the flow through a porous surface unit. It generally corresponds to a given direction of flow. In practice, the direction of flow is the radial direction towards the well. When Q=0, there is no flow allowing cleaning of the filter cake, the permeability corresponds to the damage of permeability with $k(0)=k_d$. When Q is very great, the filter cake is entirely cleaned, the permeability corresponds to the final restored permeability with $k(+\infty)=k_f$. In this case, $c_0(+\infty)=1$.

The permeability variation curve can be measured from laboratory data and it can be considered to be independent of the location in a core. Thus, a curve is used for each geologic zone. This curve is monotonic. Its maximum is generally reached for several $m^3$ (or several ten $m^3$) of fluid crossed per porous surface unit.

Permeability k at the distance r from the well during the fluid backflow period can be written in the following trivial form $$k(r, Q) = (k_f(r) - k_d(r))\frac{k_r(r, Q) - k_d(r)}{k_f(r) - k_d(r)} + k_d(r) \tag{3}$$

By using the dimensionless curves defined above and by accounting for Equation (2), permeability reduction factor c(r,Q) is expressed by:

$$c(r, Q)=(c_2(r)-c_1(r))c_0(Q)+c_1(r) \tag{4}$$

Initially, Q=0, the permeability reduction corresponds to the reduction obtained after filtrate invasion (damage permeability):

$$c(r;0)=c_1(r) \tag{5}$$

After the fluid backflow, when the amount of flowing fluid Q is very large with $c_0(Q)\approx 1$, the permeability reduction corresponds to the restored state with the stabilized restored permeability:

$$c(r;Q)=c_2(r) \tag{6}$$

The permeability variation in the zone occupied by the internal filter cake is modelled with Equation (3). Unlike the internal filter cake, the effect of the external filter cake described hereafter is modelled in the form of a skin factor in the discretized numerical model.

II-2 Grid Pattern and Numerical Schemes

Figure 3:
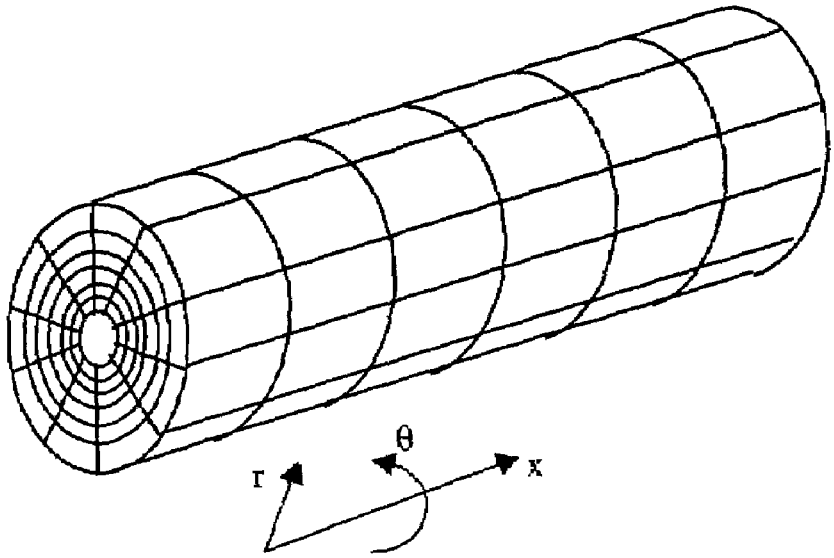
FIG. 3 shows an example of a radial grid pattern for solving the diffusivity equations.

A cylindrical grid pattern rθx is used for modelling the fluid flow in the vicinity of a horizontal well (FIG. 3): r is the radial direction, perpendicular to the axis of the well, θ is the angular direction and x is the direction along the well. With this grid pattern, the boundaries of the well are discretized and very small grid cells can be used to discretize the zone occupied by the internal filter cake. In general, the radius of the well is of the order of several centimeters, and the thickness of the internal filter cake ranges between several centimeters and several decimetres. In order to obtain a good description of the filter cake elimination phenomenon, the grid cells used in the vicinity of the well range between several millimeters and several centimeters.

Figure 4:
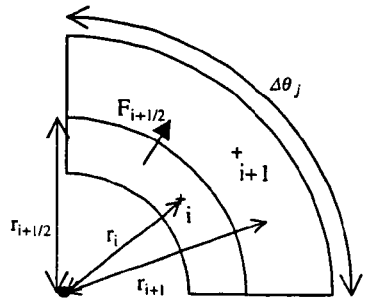
FIG. 4 illustrates the calculation of flow F with a radial grid pattern.

For cylindrical grid cells, a numerical standard scheme for approximation of the flow between two points can be used to model the flow. For example, the flow between two neighbouring grid cells i and i+1 in the radial direction is calculated by (FIG. 4):

$$F_{i+1/2}=T_{i+1/2}(p_{i+1}-p_i) \tag{7}$$

$$\text{with: } T_{i+1/2} = \frac{1}{\frac{1}{k_{r,i}}\ln\frac{r_{i+1/2}}{r_i} + \frac{1}{k_{r,i+1}}\ln\frac{r_{i+1}}{r_{i+1/2}}}\Delta\theta_j\Delta x_k \tag{8}$$

where j and k are the indices of the grid cells considered in directions θ and r, $r_i$ is the distance from grid cell i to the well, $r_{i+1/2}$ is the distance from the interface of the grid cells considered to the well, $k_{r,i}$ is the permeability of grid cell i in the radial direction, Δθ and Δx are the lengths of the grid cells in directions θ and x, and $T_i$ is the transmissivity between grid cells.

Figure 5A:
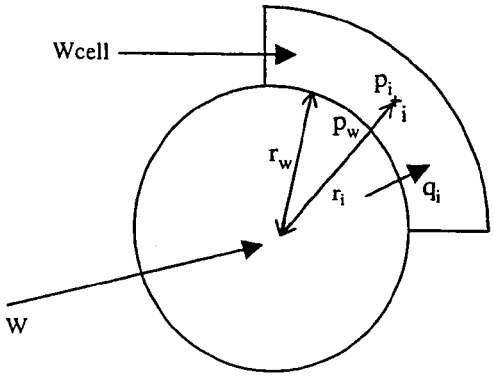
FIGS. 5*a* and 5*b* illustrate the calculation of the numerical productivity index IP without an external cake and with an external cake Cext respectively, through a grid cell Wcell.

The term "well grid cells" refers to the grid cells that discretize the well boundaries and the well boundary conditions are dealt with in the well grid cells. The internal pressure $p_w$ of the well and the flow rate $q_i$ of the well on a given grid cell i can be related by the following discretization formula (FIG. 5*a*):

$$q_i=IP_i(p_i-p_w) \tag{9}$$

$$\text{with: } PI_i = \frac{1}{\frac{1}{k_{r,i}}\ln\frac{r_w}{r_i}}\Delta\theta_j\Delta x_k \tag{10}$$

where $r_w$ is the radius of the well. This discretization at the well boundaries is similar to the approximation of the fluid flow between two grid cells. However, for discretization of the well boundaries, the discretization coefficient is denoted by the numerical productivity index IP and not by the transmissivity T, and the flow F is replaced by the flow rate $q_i$ of the well. This notation is coherent in relation to the commonly used numerical well model, and the skin factor can be integrated in the term of the numerical productivity index IP.

Permeability $k_{r,i}$ varies during the fluid backflow in the zone occupied by the internal filter cake according to the formula given in the previous section. Thus, the transmissivity and the numerical productivity index IP also vary in the simulation during the fluid backflow period.

II-3 Modelling the External Filter Cake

Figure 5B:
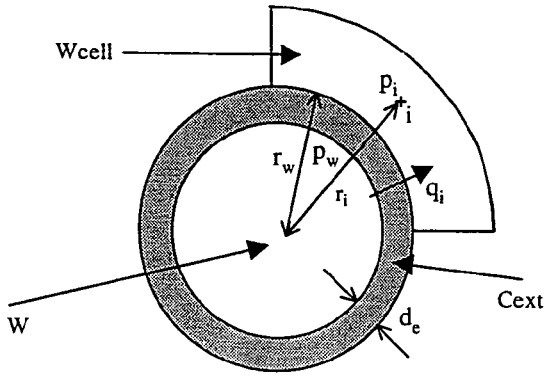

The presence of the external filter cake can be taken into account in the discretization formula via numerical index IP. In the case of the presence of an external filter cake of thickness de and of permeability $k_e$, the well pressure $p_w$ corresponds to the pressure on radius $r_w-d_e$ and not on radius $r_w$. The pressure drop is high through the external filter cake which is in the zone located between $r_w-d_e$ and $r_w$. By using again Equation (9) to connect well pressure $p_w$, the pressure of the well grid cells $p_i$ and the well flow rate $q_i$, discretization coefficient IP should integrate the effect of the external filter cake as follows (FIG. 5*b*):

$$PI_i = \frac{1}{\frac{1}{k_{r,i}}\ln\frac{r_w}{r_i} + \frac{1}{k_e}\ln\frac{r_w}{r_w - d_e}}\Delta\theta_j\Delta x_k \tag{11}$$

It is assumed that the external filter cake is eliminated if the pressure difference through the thickness thereof is above a given threshold value. Thus, at the beginning of the fluid backflow, numerical coefficient IP is calculated using Equation (11) which integrates the presence of the external cake if there is one. Once the pressure difference through the filter cake is above the given threshold, numerical productivity index IP is calculated with Equation (10).

Permeability $k_e$ of the external filter cake could generally be much lower than the permeability in the reservoir or in the zone occupied by the internal filter cake. Thus, in the presence of the external filter cake, the numerical coefficient IP is very small.

The simulations can be carried out using a flow simulation tool such as the ATHOS model for example (ATHOS is a numerical modelling model developed by the assignee). The discretization scheme used is a conventional 5-point scheme for modelling the diffusivity equation with a cylindrical grid pattern. In the grid cells in the immediate vicinity of the well, a numerical IP is used to connect the pressure in these grid cells, the bottomhole pressure and the rate of flow towards the well. Since the permeability in the vicinity of the well changes during the clearing period, the transmissivities around the well and the IP also change according to the variation of the permeabilities.

The curves which define the permeability multiplying coefficients as a function of the distance to the well, $c_1(r)$ and $c_2(r)$ are limits for c(r). The corresponding values in each grid cell are calculated from these curves using a linear interpolation as explained above. The cumulative porous volume of fluid flowing through an interface between two grid cells in radial direction r is used to calculate the multiplying coefficient of transmissivity between these two grid cells at each time considered.

III Numerical Results

We present two examples to illustrate the capacities of the method which has been developed: the first one relates to the clearing of an internal cake without an external cake, and the second one clearing in the presence of an internal cake and of an external cake.

EXAMPLE 1

Clearing in the Presence of the Internal Cake Alone

Figure 6:
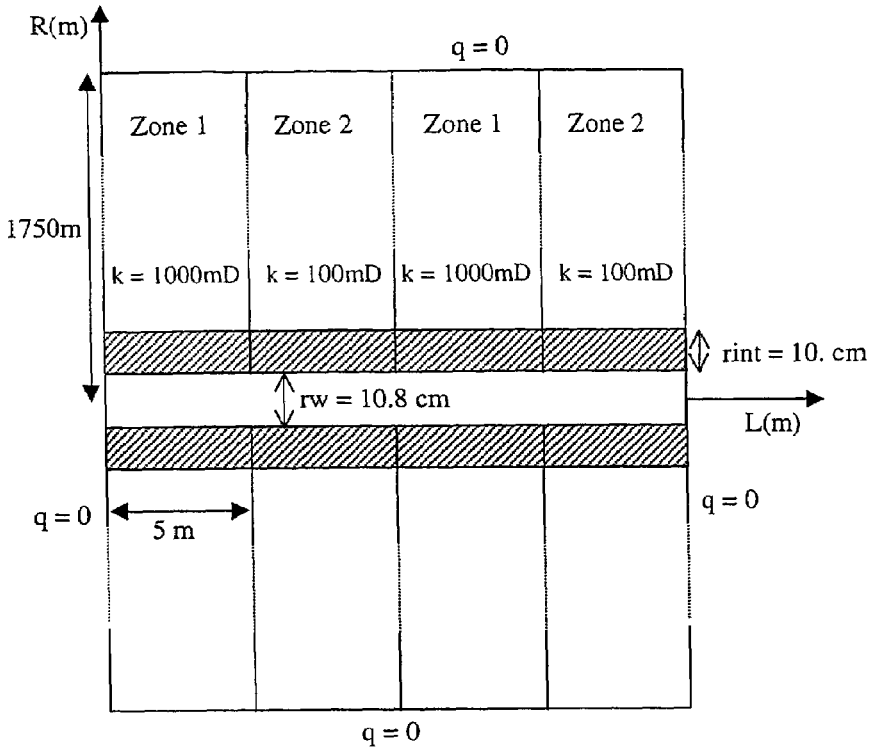
FIG. 6 diagrammatically shows a well portion of length L and of radius rw comprising 4 zones of depth r centered around the well, with different permeabilities k, 100 mD or 1000 mD, and an internal cake of thickness $r_{int}$.
Figure 7:
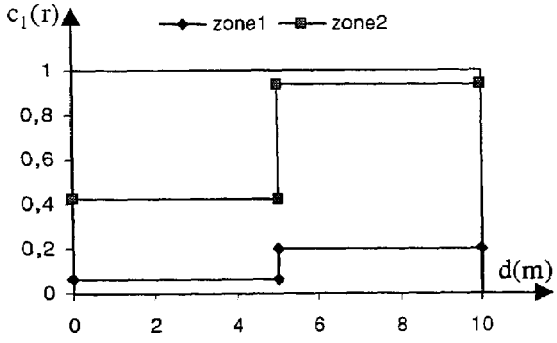
FIGS. 7, 8 show the variations, as a function of the distance d to the well, of the multiplying coefficients respectively of damaged permeability $c_1(r)$ and of restored permeability $c_2(r)$, which were measured in the laboratory in different zones and used in the examples.
Figure 8:
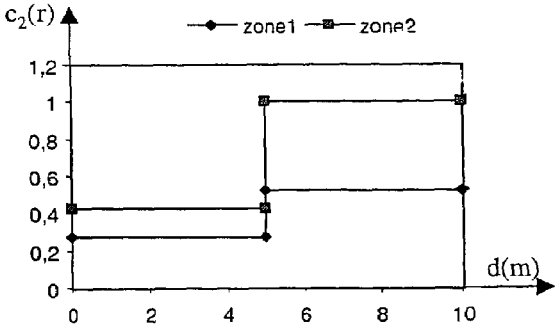
Figure 9:
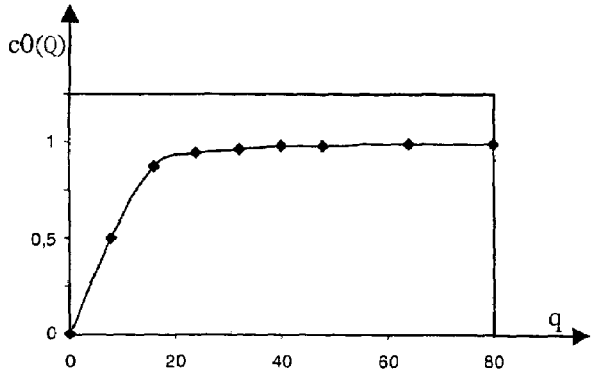
FIG. 9 shows the curve of permeability variation c0(O) in the internal cake as a function of the cumulative volume q of fluid per surface unit available for flow, measured in the laboratory and used in the examples.
Figure 10A:
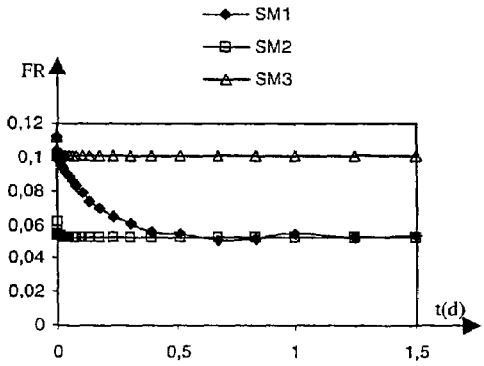
FIGS. 10*a* to 10*d* respectively show the variations, as a function of time t(d) expressed in days, of the oil flow rates FR (in $m^3/d$) in various perforated zones along the well, corresponding to 3 different simulations SM1 to SM3, in example 1 (case a)
Figure 10B:
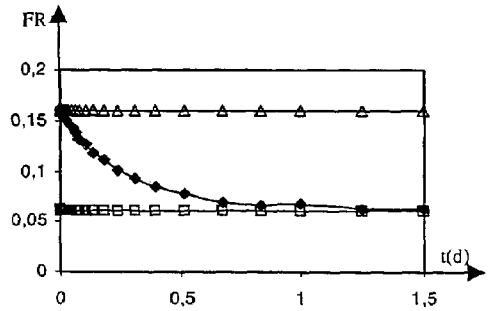
Figure 10C:
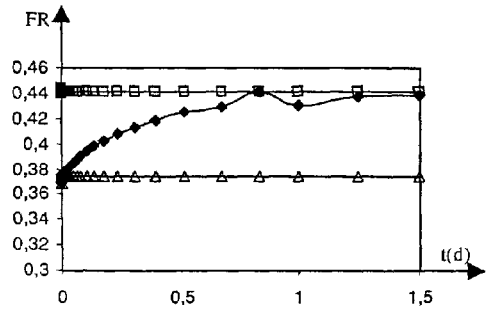
Figure 10D:
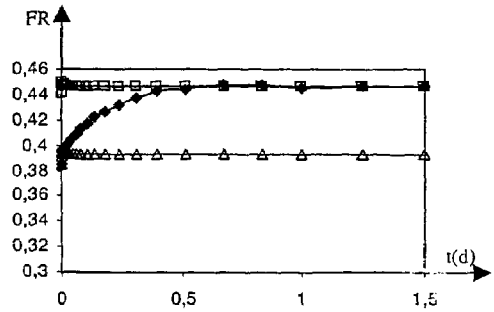

A 20-m long part of a horizontal well running through 4 zones is considered which "alternately representative of two different heterogeneity types (FIG. 6). The permeabilities k of the corresponding media, initially without damage, are 1000 and 100 mD. The length of each medium crossed is 5 m. The values of the permeability in the grid cells where the internal cake due to the damage has formed are entered manually into the data set. The curves, by zones, of the multiplying coefficient of the damage permeability as a function of the distance to the wall of the well $c_1(r)$ are given in FIG. 7. The restored permeability curves $c_2(r)$ are shown in FIG. 8. These curves are discontinuous because the data supplied by the laboratory measurements only concern some points. The larger the number of points, the better the laboratory curve is represented. The permeability variation during cleaning as a function of the amount of fluid flowing through the porous surface unit, $c_0(Q)$, is shown in FIG. 9. In practice, the maximum level can be reached with some cubic meters of fluid per surface unit.

As already mentioned, a cylindrical grid pattern is used for the simulations. The reservoir is very large in the radial direction with a 1750-m outside radius where the boundary condition is a zero flow condition. On the boundaries at the two ends of the well, the condition also is a zero flow condition. The number and the size of the grid cells in directions r and x are given in FIG. 17 (θ=360°). The well is discretized in 80 grid cells along the length thereof. Each constant-permeability zone is thus discretized in 20 0.25-m grid cells. The initial pressure in the reservoir at the depth of the well is substantially 320 bars.

Two simulations were carried out with different conditions applied to the well:

a) A 20 $m^3$/d flow rate is applied in the well for 1.5 day. The flow in the vicinity of the well simulated with the method presented above, by taking account of the permeability variation with time, is denoted by SM1. This simulation is compared with two other simulations using the conventional flow model with unchanged permeabilities, equal on the one hand to the damage permeabilities $c_1(r)$ and, on the other, to the restored permeabilities $c_2(r)$. These two simulations are denoted by SM2 and SM3.

The simulation results are presented for the grid cells 31 and 40 located in the middle and at the boundary of one of the low-permeability zones, and for grid cells 41 and 50 located at the boundary and in the middle of the next more permeable zone. FIG. 10 shows the oil flow rates at the level of these grid cells for the three simulated scenarios: SM1, SM2 and SM3. The simulations with fixed permeabilities, SM2 and SM3, give constant flow rates for each grid cell, which is normal since the boundary in direction r is not reached for the short simulated time (1.5 day). On the other hand, the flow rates vary when the permeability variations in the internal cake during recompletion are modelled. At the time 0, these flow rates are identical to those obtained for the simulations with the permeabilities resulting from well damage. They differ thereafter because the permeabilities increase in the internal cake as a result of cleaning by the formation oil. These flow rates very quickly, after one day, become similar again to those simulated with the restored permeabilities.

Figure 11A:
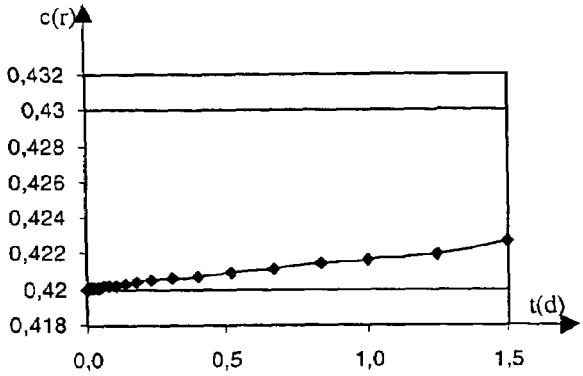
FIGS. 11*a* and 11*b* show the variations, as a function of time t(d) expressed in days, of the permeability coefficient c(r) of the internal cake in two different zones along the well (example 1)
Figure 11B:
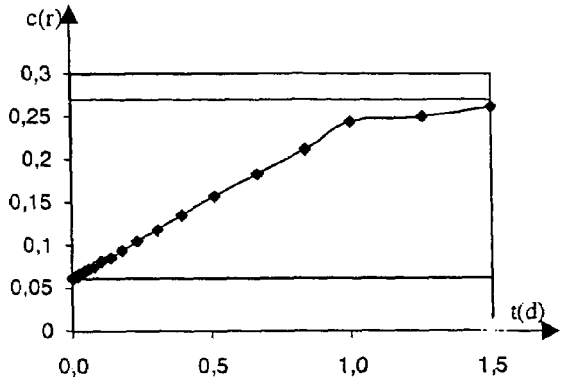

The permeability variations in grid cells 31 and 50 are shown in FIGS. 11*a*, 11*b* respectively. These variations correspond to those in the two zones. The permeabilities in the damaged and restored states are also shown. The permeability variation during cleaning lies within these boundary values. After one day, the permeability in the most permeable zone (grid cell 50) is nearly similar to the restored permeability value, and the permeability in the least permeable zone (grid cell 31) does not change much. However, as the variation between the damage permeability and the restored permeability is very low in the low-permeability zone, the simulation results mainly depend on the permeability variation in the most permeable zone. In the results shown in FIG. 10, the flow rates increase in the more permeable zones and they very quickly reach those of simulation SM3. The flow rates in the low-permeability zones decrease because the simulations are carried out with an imposed total bottomhole pressure.

This modelling procedure also allows to obtain the local velocity variation due to cake clearing.

b) A 1-bar pressure difference is applied during 1.5 day.

Figure 12:
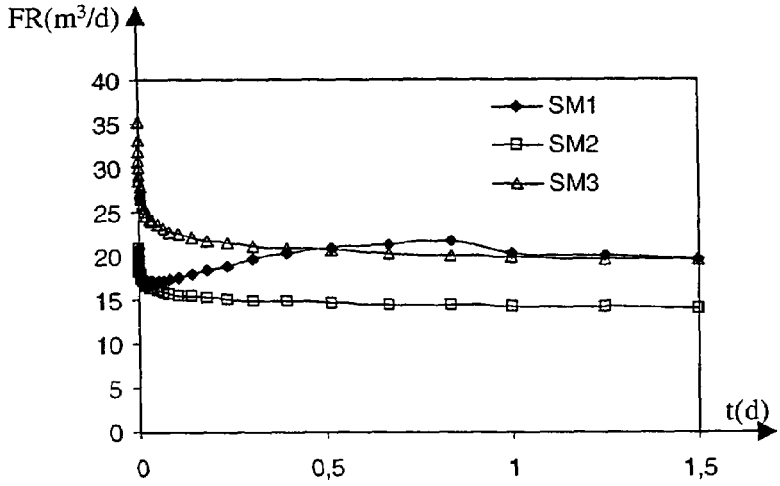
FIG. 12 shows the variation, as a function of time, of the total flow rate FR ($m^3/d$) in the case c of example 1, for three different simulations SM1 to SM3.

FIG. 12 shows the variation, as a function of the time t expressed in days, of the corresponding simulated flow rates FR (expressed in $m^3/d$) in the well. In the case of an unchanged permeability (SM2 and SM3), the flow rates decrease with time. On the other hand, modelling of a progressive clearing gives an increasing flow rate up to about one day, which decreases thereafter. The flow rate increase during the initial period is due to the permeability increase in the internal cake during recompletion.

The results in grid cells 31, 40, 41 and 50 are very similar to those of case a. The flow rates obtained when modelling the cake cleaning operation at the time t=0 are equal to those simulated with the damage permeabilities; they vary thereafter and reach the values of the flow rates simulated with the restored permeabilities.

In this example, it is observed that well cleaning is rather fast whatever the scenario modelled. In any case, the results of the progressive clearing simulation SM1 are very close, after one day, to those obtained with the restored permeabilities SM3. It is possible to provide details of the short-time results such as, for example, the flow rates along the well, the pressures and the velocities in the vicinity of the well, in order to better know what occurs during clearing. However, the long-time performances of the well, after several days, are nearly identical whatever the configurations studied, knowing that the geomechanical aspects are not taken into account. On this hypothesis, it thus appears that the effects of the internal cake on the well performance are very limited in time and that it is generally sufficient to study this performance by considering the restored permeability, i.e. that of the configuration denoted by SM3.

EXAMPLE 2

Presence of a Non-Uniform External Cake Along the Horizontal Well

Figure 13:
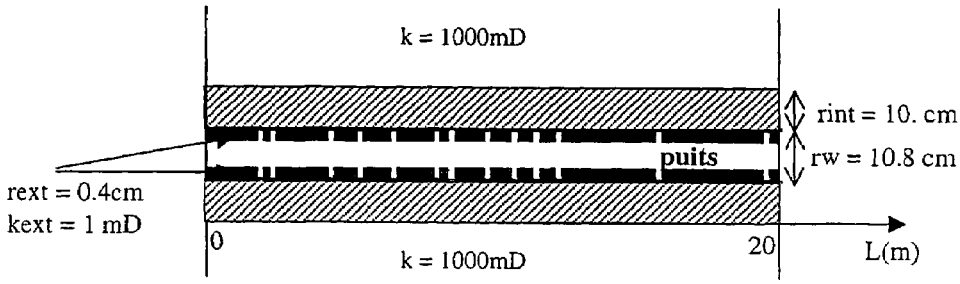
FIG. 13 shows the distribution of the external cake along the well portion, in example 2.

The same well geometry is considered as in the previous example. In this example, the reservoir is homogeneous with a 1000-mD permeability in the porous medium. The external cake has no homogeneous presence along the well. In some places, there is no external cake, and in the places where the external cake is present, it has a 1-mD permeability $k_{ext}$ and a 4-mm thickness $r_{ext}$ as in the previous example. The distribution of the presence of the external cake is given in FIG. 13. The pressure difference required for removing the external cake is still set at 0.5 bar.

Two types of boundary conditions are used in the simulations. For the first case, a 318.2-bar pressure is applied at the well bottom, i.e. a 1.8-bar pressure difference between the reservoir and the well. For the second case, several consecutive pressure stages are applied to reach a total 1.8-bar pressure drop (Table 2).

Figure 14A:
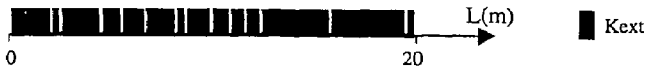
FIGS. 14*a* to 14*c* respectively show in example 2 the distribution, over length L(m) of the well, of the external cake (FIG. 14*a*) and of flow rate FR along the well at the time t=0.5 d (FIG. 14*b*) and at the time t=5 d (FIG. 14*c*)
Figure 14B:
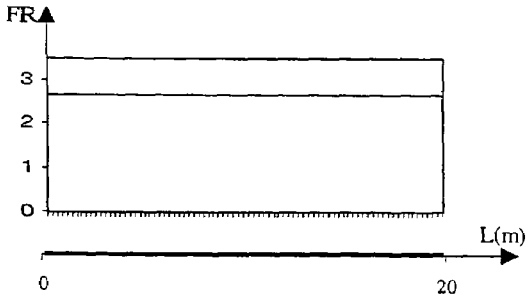
Figure 14C:
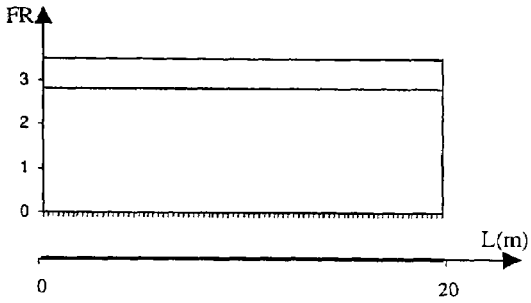
Figure 15A:
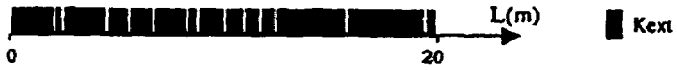
FIGS. 15*a* to 15*f* respectively show in example 2 the distribution, over length L(m) of the well, of the external cake (FIG. 15*a*) and of flow rate FR along the well, respectively at the time t=0.1 d (FIG. 15*b*), t=0.3 d (FIG. 15*c*), t=0.5 d (FIG. 15*d*), time t=1 d (FIG. 15*e*) and t=5 d (FIG. 15*f*)
Figure 15B:
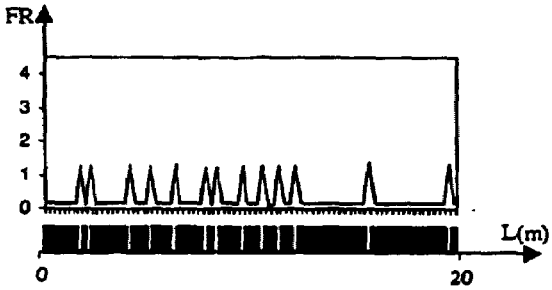
Figure 15C:
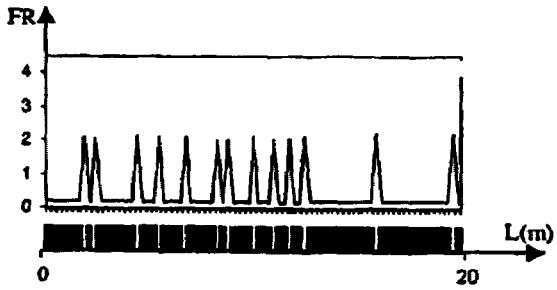
Figure 15D:
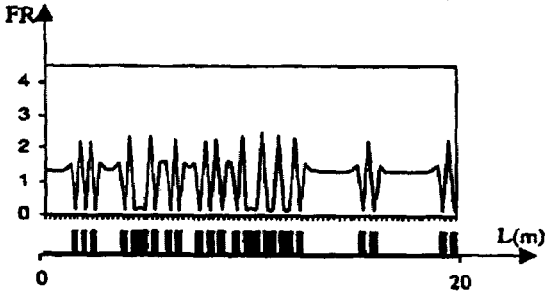
Figure 15E:
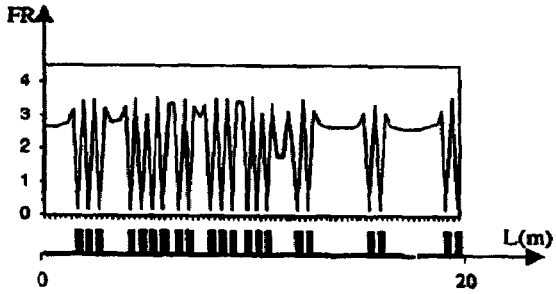
Figure 15F:
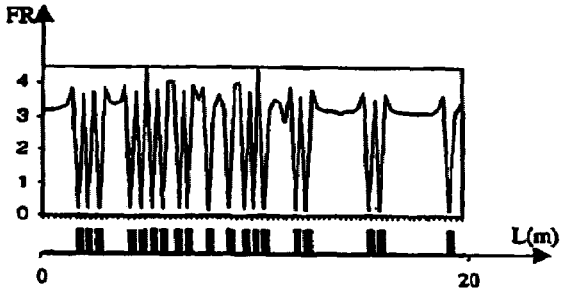
Figure 16:
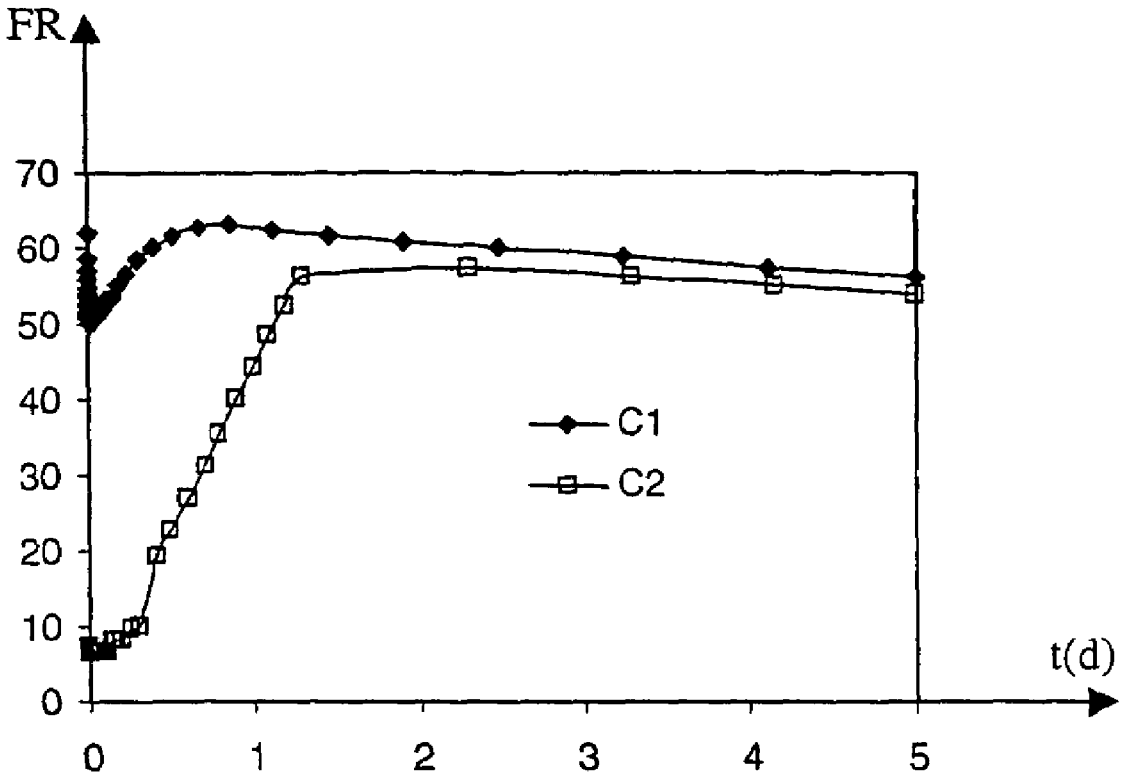
FIG. 16 shows the total flow rate FR of the well as a function of the time expressed in days, in example 2, for cases c1 and c2.

FIGS. 14 and 15 show the distribution of the external cake and the distribution of the flow rate along the well for these two cases at different production times. In the first case, the flow rates are uniform along the well because the external cakes are entirely removed from the beginning. In the second case, the flow rate distribution varies as a function of time because the external cakes are removed in a non-uniform way at different times. Furthermore, there always are external cakes that cannot be removed after 5 days. FIG. 16 shows the well production for these two cases. In the first case, the well production is higher because all the external cakes are removed from the beginning. But the maximum local flow rate along the well still is below 3 $m^3$/m.day. In the second case, the well flow rate is lower but the local flow rate can be very high with a maximum value of 4.5 $m^3$/m.day. The cakes cannot always be removed in certain places. The well performance is thus greatly reduced in this case. This example shows that the clearing procedures can influence the well performance even in a homogeneous reservoir.

Although it would be understandable to apply a great pressure difference between the well and the formation, since it is the procedure which allows fastest and most uniform removal of the external cake which limits the well flow rate, it may be dangerous for the integrity of the well to do so if the formation is not consolidated, and sand encroachment is likely to occur and eventually clog the well. It is one of the interests of the present invention to allow to define the best well clearing procedure without causing the aforementioned hazard from the moment that the fluid velocity from which the sand loses its cohesion is known.

The invention claimed is:

1. A method of simulating optimum conditions to be applied in a well drilled through an underground reservoir with any trajectory so as to progressively eliminate, by means of fluids from the reservoir, deposits or cakes formed in at least a peripheral zone of the well as a result of drilling and completion operations, comprising:

acquiring initial data obtained by laboratory measurements of a thickness of the cakes and of damaged permeability and restored permeability values of the peripheral zone, as a function of distance to the wall of the well; according to an initial permeability value of the formation surrounding the well;

discretizing a damaged zone by means of a 3D cylindrical grid pattern forming blocks of a radial thickness in relation to a diameter of the well; and solving in the grid pattern a diffusivity equation modelling flow of fluids through the cakes by accounting for measured initial data and by modelling evolution of permeability as a function of flow rates of fluids flowing through the cakes, so as to deduce therefrom optimum conditions to be applied for producing from the well.

2. A method as claimed in claim 1, wherein restoration of the permeability at any point at a distance from the well is modelled by considering that the permeability varies proportionally to the difference between the damaged permeability and the restored permeability the proportionality coefficient depending on an empirical law of permeability variation as a function of a quantity of fluids flowing through the cakes.

* * * * *